US007780163B2

(12) United States Patent
Schinzel-Reiner et al.

(10) Patent No.: US 7,780,163 B2
(45) Date of Patent: Aug. 24, 2010

(54) DEVICE AND METHOD FOR ALIGNING BANK NOTES

(75) Inventors: Gerhard Schinzel-Reiner, Munich (DE); Frank Werner, Munich (DE)

(73) Assignee: Giesecks & Devrient GmbH, Munich (DE)

( * ) Notice: Subject to any disclaimer, the term of this patent is extended or adjusted under 35 U.S.C. 154(b) by 597 days.

(21) Appl. No.: 10/523,696

(22) PCT Filed: Aug. 5, 2003

(86) PCT No.: PCT/EP03/08668

§ 371 (c)(1),
(2), (4) Date: Aug. 2, 2005

(87) PCT Pub. No.: WO2004/014768

PCT Pub. Date: Feb. 19, 2004

(65) Prior Publication Data

US 2006/0038340 A1 Feb. 23, 2006

(30) Foreign Application Priority Data

Aug. 6, 2002 (DE) ..... 102 36 028

(51) Int. Cl.
*B65H 7/02* (2006.01)
*B65H 9/00* (2006.01)
*B65H 9/16* (2006.01)

(52) U.S. Cl. ..... 271/227; 271/226; 271/251

(58) Field of Classification Search ..... 271/227, 271/228, 251, 226
See application file for complete search history.

(56) References Cited

U.S. PATENT DOCUMENTS

| | | | | |
|---|---|---|---|---|
| 3,984,098 | A | 10/1976 | Stange et al. | |
| 5,140,166 | A * | 8/1992 | Gerlier | 250/548 |
| 5,253,862 | A * | 10/1993 | Acquaviva et al. | 271/251 |
| 5,329,852 | A | 7/1994 | Bolza-Schuenemann et al. | |
| 5,577,719 | A * | 11/1996 | Nicoll | 271/227 |
| 5,697,609 | A * | 12/1997 | Williams et al. | 271/228 |
| 5,755,437 | A * | 5/1998 | Ek | 271/227 |
| 6,019,365 | A * | 2/2000 | Matsumura | 271/227 |
| 6,042,110 | A * | 3/2000 | Inage | 271/251 |
| 6,059,284 | A * | 5/2000 | Wolf et al. | 271/227 |
| 6,059,285 | A * | 5/2000 | Suga et al. | 271/228 |

(Continued)

FOREIGN PATENT DOCUMENTS

DE 24 57 069 A 6/1976

(Continued)

*Primary Examiner*—Patrick Mackey
*Assistant Examiner*—Patrick Cicchino
(74) *Attorney, Agent, or Firm*—Rothwell, Figg, Ernst & Manbeck, P.C.

(57) ABSTRACT

An apparatus and a method for aligning bank notes in a transport system in which, when aligning bank notes in a transport system the alignment of a bank note transported separately in the transport system is detected, that it is checked, whether the detected alignment of the single bank note is a misalignment, that the single bank note according to the detected misalignment is aligned in a desired alignment by a movement of the single bank note in a direction deviating from the transport direction of the transport system, the alignment of the single bank note during the aligning being detected, and the aligning being terminated, as soon as the single bank note has the desired alignment.

13 Claims, 3 Drawing Sheets

U.S. PATENT DOCUMENTS

| | | | | |
|---|---|---|---|---|
| 6,273,418 | B1 * | 8/2001 | Fujikura et al. | 271/228 |
| 6,276,586 | B1 * | 8/2001 | Yeo et al. | 226/17 |
| 7,416,182 | B2 * | 8/2008 | Nishida et al. | 271/228 |
| 2001/0040331 | A1 * | 11/2001 | Forch et al. | 270/58.01 |
| 2003/0057637 | A1 * | 3/2003 | Kawamura et al. | 271/227 |
| 2005/0012263 | A1 * | 1/2005 | Koyanagi et al. | 271/227 |
| 2006/0163801 | A1 * | 7/2006 | Dejong et al. | 271/227 |
| 2007/0040326 | A1 * | 2/2007 | Noda et al. | 271/227 |

FOREIGN PATENT DOCUMENTS

| | | | |
|---|---|---|---|
| DE | 26 53 807 | A1 | 6/1977 |
| DE | 91 16 439 | U1 | 11/1992 |
| DE | 696 09 227 | T2 | 11/2000 |
| DE | 101 48 367 | A1 | 4/2003 |
| EP | 0 431 267 | | 6/1991 |
| EP | 0 431 267 | A1 | 6/1991 |
| EP | 0 736 473 | | 10/1996 |
| EP | 0 736 473 | A2 | 10/1996 |
| EP | 0 928 763 | A2 | 7/1999 |
| EP | 1 188 699 | | 3/2002 |
| EP | 1 188 699 | A2 | 3/2002 |
| EP | 1 295 825 | A2 | 3/2003 |
| JP | 03264429 | * | 11/1991 |
| JP | 04041348 | * | 2/1992 |

* cited by examiner

DEVICE AND METHOD FOR ALIGNING BANK NOTES

CROSS-REFERENCE TO RELATED APPLICATION

This application is a National Phase of International Application Serial No. PCT/EP03/08668, filed Aug. 5, 2003.

FIELD OF THE INVENTION

The present invention relates to an apparatus and a method for aligning bank notes in a transport system.

DESCRIPTION OF THE BACKGROUND ART

Apparatuses and methods for aligning bank notes in a transport system usually have means, which move the bank notes to be aligned in a direction deviating from the transport direction of the transport system and direct them against a guiding element, so as to urge an edge of the bank notes, which is parallel to the transport direction, against a guiding element, so that the bank note has a desired alignment. Usually, for this purpose rollers are used, which are moved by a motor and disposed in the transport system in such a way, that they propel bank notes transported by the transport system in a direction oblique to the transport direction, so as to urge them against the guiding element. Here the rollers act on the bank note, which is transported past, along its entire length or across its entire width. As a result of this there is the possibility that the bank note is deformed, for example folded, when it is urged against the guiding element. This also leads to the fact, that the actual goal, namely aligning the bank note in a desired alignment is not achieved, because the alignment effected by the rollers deviates from the desired alignment.

For improving this problem EP 1 188 699 A2 proposes to use rollers, which are disposed in the transport system and act on the entire length or width of the transported bank notes, the rollers being disposed on a framework, which is adapted to be adjusted by a motor. Furthermore, the prior art apparatus has a sensor unit, which is located in the transport system in front of the rollers and determines the alignment of the bank notes each transported past the sensor unit. Dependent on the determined alignment of the bank note, the rollers or the framework supporting the rollers are adjusted by the motor in such a way, that the movement of the bank note effected by the rollers is dimensioned in such a way, that the bank note, after having completely traversed the rollers, has the desired alignment.

The prior art apparatus therefore has the disadvantage, that the influence of the rollers required for aligning the bank note is determined without taking into consideration the properties of the bank note, which potentially may influence the aligning. Dependent on the state of the bank note, its friction may vary. Very dirty bank notes or limp bank notes normally have a higher friction, whereas new or freshly printed bank notes have less friction. Similarly, the friction coefficient of the rollers may vary, namely when the rollers have been soiled during the operation. These factors in general have the effect, that when aligning by means of the rollers used in the prior art apparatus, the desired alignment is not achieved, because e.g. due to the fluctuations in friction occurring during the operation the desired alignment cannot be achieved to a precise degree. In addition it is a problem, that the rollers act on the transported bank note along its entire length and across its entire width. In particular with bank notes, which exhibit a damage, such as tears or the like, it can occur, that due to the force exerted by the rollers the already damaged bank note is further damaged or definitely destroyed.

SUMMARY OF THE INVENTION

It is therefore the problem of the present invention to specify an apparatus and a method for aligning bank notes in a transport system, which reduce the influence exercised on the respective bank note to be aligned to a minimum required for the intended aligning, whereby for any bank note—and independently of its state—the desired alignment shall be achieved.

This problem is inventively solved by the features described herein.

The invention starts out from the facts, that when aligning bank notes in a transport system the alignment of a bank note transported separately in the transport system is detected, that it is checked, whether the detected alignment of the single bank note is a misalignment, that the single bank note according to the detected misalignment is aligned in a desired alignment by a movement of the single bank note in a direction deviating from the transport direction of the transport system, the alignment of the single bank note during the aligning being detected, and the aligning being terminated, as soon as the single bank note has the desired alignment.

For this reason the invention in particular has the advantage, that the influence on the single bank note during the aligning is reduced to the required minimum by terminating the aligning as soon as the single bank note has the desired alignment. Therefore, unnecessary loadings on the bank note during the aligning, such as for example a deformation of the bank note, do not occur. In addition, the invention has the advantage, that the bank note precisely has the desired alignment, since the aligning is terminated, when the desired alignment has been achieved. Thus, in any case, an influencing of the bank note beyond the desired alignment does not occur, even with the most different bank notes or most different states of the bank notes or the apparatus for aligning, such as maybe caused by e.g. soiling or damaging.

In an advantageous embodiment of the invention it is provided, that the distance of the single bank note from a bank note located in front of it in the transport system and/or to a bank note located after it in the transport system is determined and the single bank note is slowed down and/or stopped, so as to achieve a predetermined distance between the single bank note and the bank note located in front of it and/or after it in the transport system, if the determined distance does not correspond to the predetermined distance.

The advantageous embodiment of the invention thus has the advantage, that a transport cycle for the bank notes predetermined in the transport system can be precisely met, since deviations from the predetermined transport cycle—and thus from the predetermined distance between the bank notes—are equalized by stopping a bank note for a short time and/or by slowing down its transport speed, so as to achieve the desired distance and thus the desired transport cycle.

BRIEF DESCRIPTION OF THE DRAWINGS

Further advantages of the present invention appear from the dependent claims as well as the following description of embodiments with reference to Figures.

DETAILED DESCRIPTION OF THE INVENTION

In the Figures only those components are shown, which are of importance in connection with the present invention. Components of the same kind shown in different Figures have the same reference sign.

Figure 1:
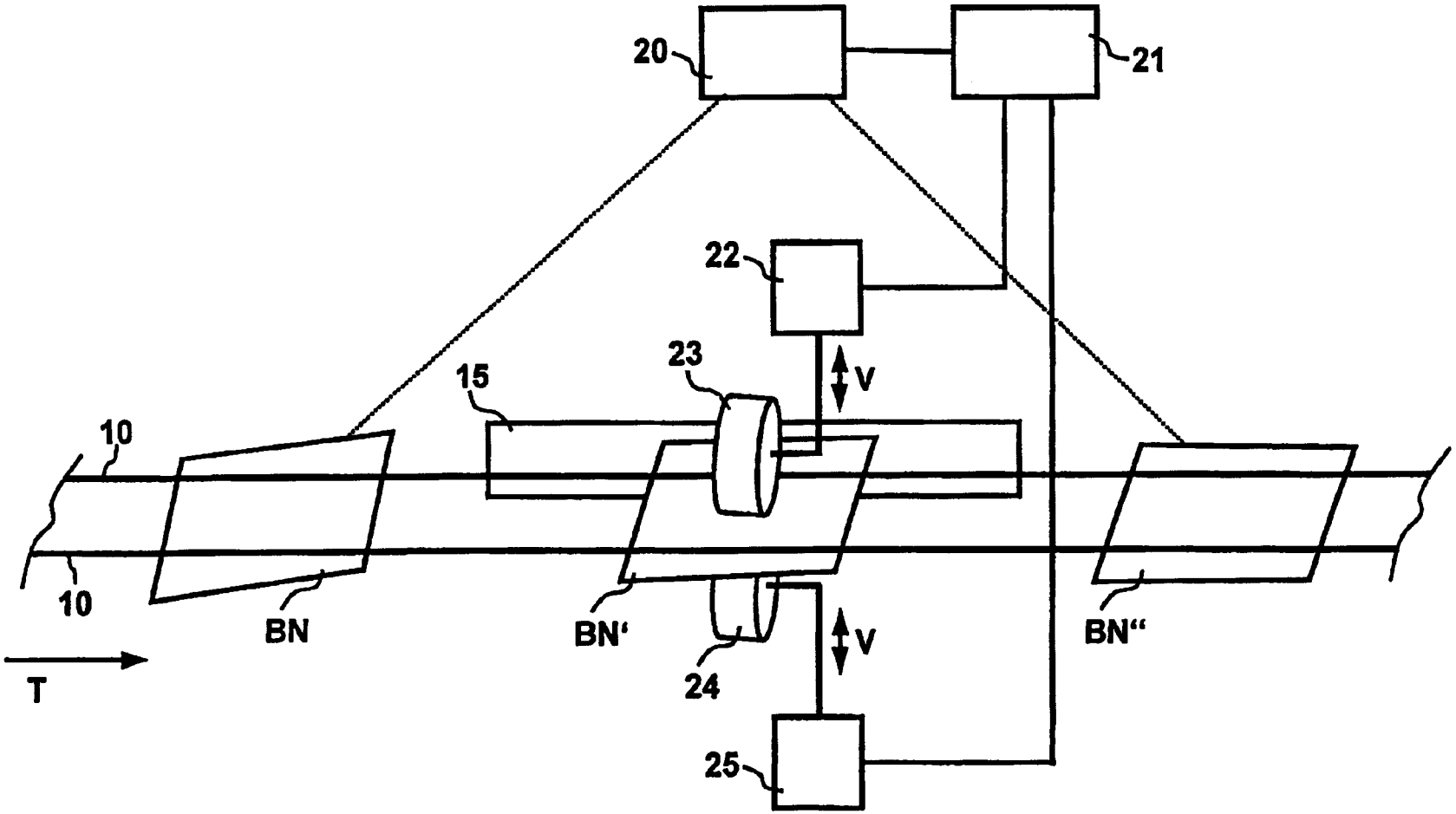
FIG. 1 shows a first embodiment of a structure of an apparatus for aligning bank notes in a transport system.

FIG. 1 shows a first embodiment of a basic structure of an apparatus for aligning bank notes in a transport system.

The apparatus is disposed in a transport system 10, which transports bank notes BN, BN', BN". The bank notes can come, for example, from a singler, which separately withdraws the bank notes from a stack of bank notes and transfers them to the transport system 10, which supplies the bank notes to processing. When the bank notes are singled by the singler and when the singled bank notes are transferred to the transport system 10, it can occur that a bank note BN has not the desired alignment. The desired alignment of the bank note usually is of such a direction that two edges of the bank note, in the shown example the longitudinal edges, extend parallel to a transport direction T of the transport system. In case the bank note is transported along its short edges, of course, the short edges shall be aligned parallel to the transport direction T.

In the transport system 10 means for aligning 22 to 25 are disposed, which arrange a bank note BN' in a desired alignment by setting the bank note in a motion, which deviates from the transport direction T of the transport system 10. In the shown example the means 22 to 25 are formed by two rollers 23 and 24, the means for aligning 22 to 25 having components 22 and 25, which are adapted to displace the rollers 23 and 24 in a direction marked by arrows with the reference sign V. The components 22 and 25 can be formed, for example, by lifting magnets. By means of the lifting magnets 22 and 25 it is possible to move the rollers 23 and 24 to the level of the transport system 10, on which the bank notes are transported.

By means of a device for detecting the alignment 20, which for example can be formed by an optical sensor, in particular by a camera producing a two-dimensional image, the alignment of the bank note BN is detected. A device for checking the detected alignment 21, which for example can be formed by a microcomputer, checks the alignment of the bank note BN detected by the device for detecting the alignment 20. In case the alignment of the bank note BN deviates from the desired alignment, the microcomputer 21 activates the lifting magnets 22 and 25, so as to bring the rollers 23 and 24 to the level of the bank note transport, when the bank note BN' is located in the area of the rollers 23 and 24. At least one of the rollers 23 and 24 is driven by a motor in such a way that the roller sets the bank note BN' in a motion, which deviates from a transport direction T.

During the aligning the optical sensor 20 and the microcomputer 21 monitor the current alignment of the bank note BN'. If during the aligning is determined, that the bank note BN' has the desired alignment, the microcomputer 21 activates the lifting magnets 22 and 25, so as to remove the rollers 23 and 24 from the level of the bank note transport. As to equalize inertias present in the system, this control command can be given by the microcomputer 21 even shortly before the desired alignment is reached, so as to equalize the inertias present. The bank note BN" then is transported in the desired alignment to further processing by the transport system 10.

For aligning the bank note BN by means of the rollers 23 and 24 there can be provided, that the rollers 23 and 24 have surfaces with increased friction, for example a rubberized surface. Analogously, there can be provided, that the above-described motor for driving at least one of the rollers 23 and/or 24 is component of the rollers. The rollers 23 and 24 can have any different alignment beside the alignment as shown in the Figure, in so far as this alignment is not parallel to the transport direction T. Analogously, it is possible to provide more than two rollers, which are disposed along one or more axes, the axes not extending perpendicular to the transport direction T. Using more than two rollers permits a more purposeful influence on the bank note BN'.

One possibility to stabilize the alignment is the use of a guiding element 15, which is disposed in the area of the means for aligning 22 to 25. The guiding element 15 has an orientation, which is parallel to the transport direction T and thus has the desired alignment.

Figure 2:
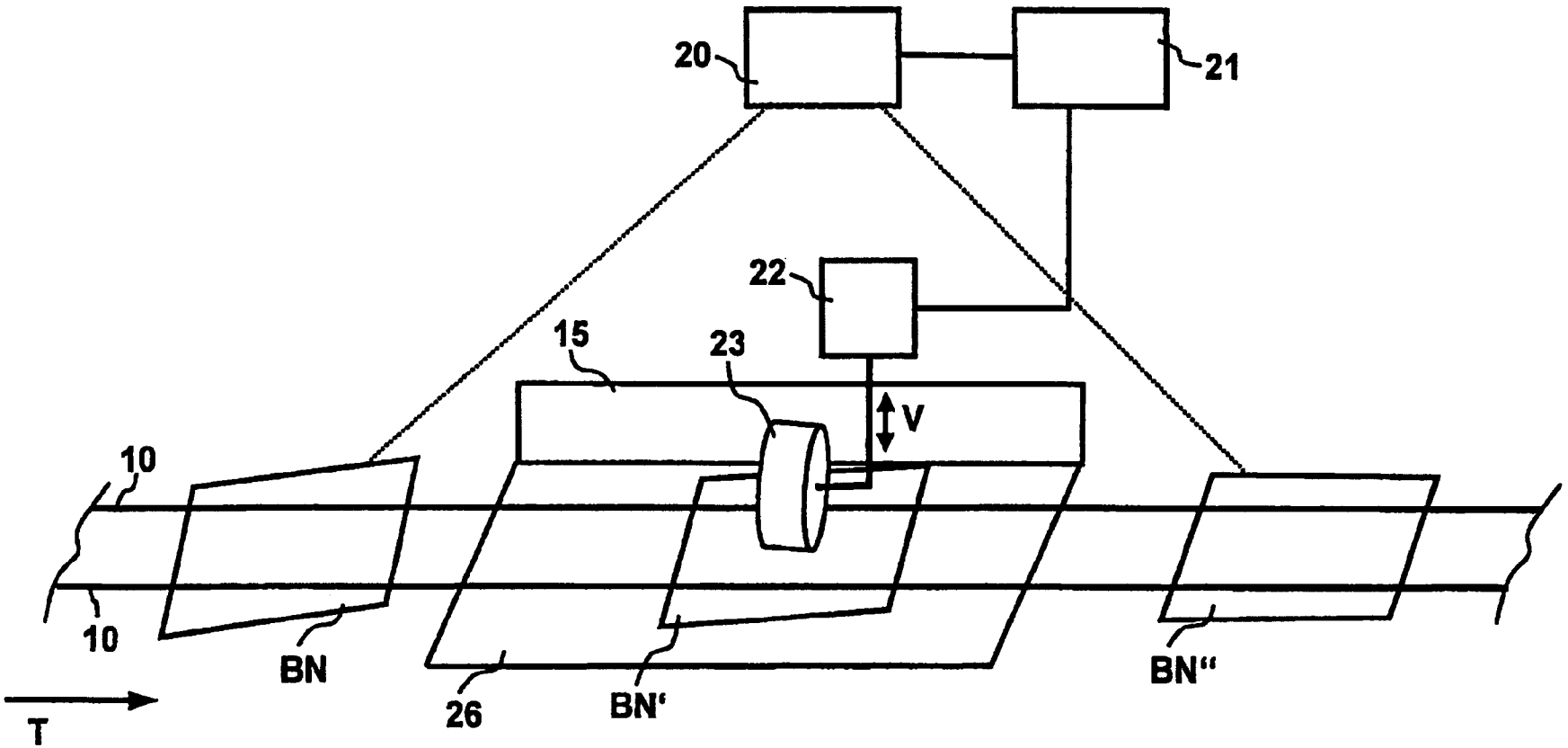
FIG. 2 shows a second embodiment of a structure of an apparatus for aligning bank notes in a transport system.

FIG. 2 shows a second embodiment of a basic structure of an apparatus for aligning bank notes in a transport system.

The second embodiment according to FIG. 2 essentially corresponds to the first embodiment according to FIG. 1. In contrast to the first embodiment, the means for aligning 22 and 23, however, have only one single roller 23 and one single lifting magnet 22. The activation of the lifting magnet 22, and thus the roller 23, corresponds to the activation of the components as described above in connection with FIG. 1 with the same reference signs. However, in the area of the roller 23 there is a cover 26, over which the bank note BN' is transported by the transport system 10. If the roller 23 is moved towards the cover 26 by the lifting magnet 22, controlled by the microcomputer 21, the bank note BN" can be aligned in the fashion as described above in connection with FIG. 1.

Figure 3:
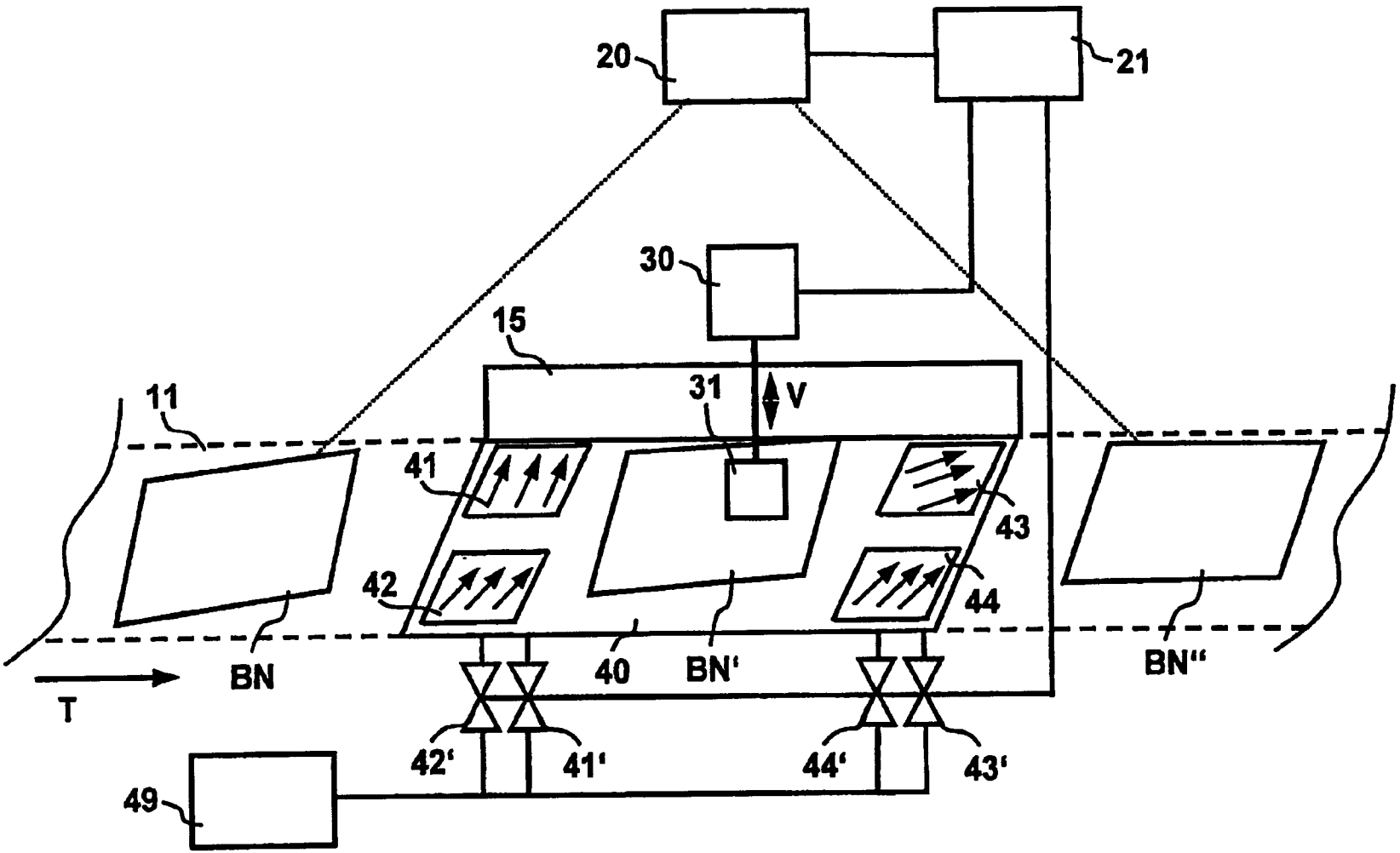
FIG. 3 shows a third embodiment of a structure of an apparatus for aligning bank notes in a transport system.

FIG. 3 shows a third embodiment of a basic structure of an apparatus for aligning bank notes in a transport system.

The transport system 11 transports single bank notes, which for example can come from a singler, along a transport direction T, so as to supply them to processing. The transport system 11 can be of any structure, for example a roller transport system or belt transport system. The transport system 11 is interrupted by an air baffle plate 40, which effects the transportation of the bank notes by means of an air flow. The air flow of the air baffle plate 40 is produced by means of a plurality of openings in the plane of the air baffle plate, this air flow moving the bank note along the transport direction T. Moreover, the apparatus has a device for detecting the alignment 20 of the bank notes, e.g. an optical sensor, in particular a camera, as well as a device for checking the detected alignment 21, for example a microcomputer. If the microcomputer 21 determines the deviation of a bank note BN, it can alter the air flow produced by the air baffle plate 40 in such a way, that the bank note BN' is moved in a direction deviating from the transport direction T, so as to achieve a desired alignment. For this purpose the microcomputer 21 activates valves 41' to 44', which are connected to an air supply 49. The air flow coming from the air supply 49 is guided via the valves 41" to 44" to areas 41 to 44 in the air baffle plate 40, which have openings directing the air flow in such a way, that this air flow directs the bank note BN' in a direction deviating from the transport direction T. If the sensor unit 20 detects and the microcomputer 21 determines, that the bank note BN' has the desired alignment, the valves 41' to 44' are locked, so that the air flow through the areas 41 to 44 of the air baffle plate is stopped. I.e. the bank note BN' is delivered to the transport system following the end of the air baffle plate 40 in an aligned form and is transported as an aligned bank note BN" to further processing.

As to equalize inertias present in the described apparatus, there can be provided, that the valves 41' to 44' are locked even before the alignment of the bank note BN" is definitely achieved. The definite alignment of the bank note BN' then is effected by the existing inertias. Analogously, it is possible, that to the air baffle plate 40 a guiding element 15 is connected, which has the desired alignment.

The processes described up until now in connection with the three embodiments serve for equalizing misalignments, such as misalignments as described above, for example, caused by the singler used. The bank notes BN, BN' and BN" shown in the FIGS. 1 to 3, which were viewed as one bank note at different points of time up until now, shall be viewed as different bank notes in the following description. In addition to the described misalignments, the singler—or other components of the transport system—can also cause a time lag between the individual bank notes. This time lag results in a different distance between bank notes succeeding each other in the transport system.

Since with the processing of bank notes in general a regular and predetermined distance between bank notes succeeding each other is desired, additionally a device 30, 31 for slowing down and/or stopping the single bank note BN' can be provided. If the sensor unit 20 as well as the microcomputer 21 determine, that the distance between two bank notes succeeding each other, e.g. BN and BN', does not correspond to the desired distance, then by means of the device 30, 31 a force can be exerted to the bank note BN', which at least briefly stops the bank note BN' or reduces its transport speed. In this way the desired distance can be achieved. The described proceeding is suitable, when the distance between the bank notes BN and BN' is too large. In case the distance between the bank notes BN and BN' is too small, it is obvious, that instead of the bank note BN' the bank note BN is stopped for a short time or the transport speed is reduced, when the bank note BN is located in the area of the device 30, 31. The device 30, 31 can have the form of a lifting magnet 30, which, for example, moves a rubberized element 31 to the level of the bank note transport, so as to effect the desired stop or speed reduction of the bank note BN".

It is obvious, that the device 30, 31 described in connection with FIG. 3 can be also used for the embodiments of the FIGS. 1 and 2.

The apparatus described above with reference to different embodiments as well as the transport system comprising these embodiments advantageously can be component of an automatic counter for receiving bank notes, analogously they advantageously can be component of a bank-note processing machine, which is used for counting and/or checking and/or sorting bank notes.

The invention claimed is:

1. A method for aligning bank notes in a transport system, with the following steps:

detecting an alignment of a bank note being transported separately in the transport system, determining from the detected alignment a deviation of the single bank note from a desired alignment wherein two edges of the bank note extend parallel to the transport direction of the transport system, aligning the single bank note in the desired alignment by displacing the single bank note in a non-contacting fashion using one air flow, which aligns the single bank note by displacing the bank note in a direction deviating from the transport direction based on the deviation, detecting the alignment of the single bank note during the aligning, said aligning while the bank note to be aligned is being transported in the transport direction, and terminating the aligning, as soon as the single bank note has the desired alignment, wherein said one air flow is stopped before the bank note has the desired alignment and an inertia of the bank note is permitted to achieve the alignment.

2. Method according to claim 1, characterized in that the distance is determined of the single bank note at least one of from a bank note located in front of it in the transport system or to a bank note located after it in the transport system, and the single bank note is at least one of slowed down or stopped, so as to achieve a predetermined distance between the single bank note and the bank note located at least one of in front of it or after it in the transport system, if the determined distance does not correspond to the predetermined distance.

3. An apparatus for aligning bank notes in a transport system, with a device for detecting an alignment of a bank note being transported separately in the transport system, a device for determining from the detected alignment a deviation of the single bank note from a desired alignment wherein two edges of the bank note extend parallel to the transport direction of the transport system, and means for aligning the single bank note in the desired alignment by displacing the bank note in a direction deviating from the transport direction, while the bank note to be aligned is being transported in the transport direction, said means controlled by the device for determining a deviation, wherein the device for detecting the alignment detects the alignment of the single bank note in the area of the means for aligning, while the means for aligning is aligning the single bank note, and the device for determining a deviation stops the means for aligning, as soon as the single bank note has the desired alignment;

wherein the means for aligning act on the single bank note in a non-contacting fashion and produce one air flow, which aligns the single bank note by displacing the bank note in a direction deviating from the transport direction of the transport system;

wherein said one air flow produced by the means for aligning is stopped before the bank note has the desired alignment and the means for aligning permits an inertia of the bank note to achieve the alignment.

4. The apparatus according to claim 3, wherein the device for detecting the alignment detects a two-dimensional area.

5. The apparatus according to claim 3, wherein the means for aligning mechanically act on the single bank note.

6. The apparatus according to claim 3, wherein the device for detecting an alignment and the device for determining from the detected alignment detect and determine the distance between the single bank note and a bank note located in front of it in at least one of the transport system and a bank note located after it in the transport system, and that a device, controlling the device for checking the detected alignment, at least one of slows down and stops the single bank note, so as to achieve a predetermined distance between the single bank note and the bank note located at least one of in front of it or after it in the transport system, if the determined distance does not correspond to the predetermined distance.

7. The apparatus according to claim 6, wherein the device for at least one of slowing down or stopping the single bank note mechanically acts on the bank note.

8. The apparatus according to claim 3, wherein the transport system has a guiding element, against which the single bank note is directed by the means for aligning, the guiding element having the desired alignment.

9. The apparatus according to claim 3, wherein the apparatus and the transport system are components of an automatic counter for receiving bank notes.

10. The apparatus according to claim 3, wherein the apparatus and the transport system are components of a bank-note processing machine for at least one of counting, checking or sorting bank notes.

11. The apparatus according to claim 4, wherein the device for detecting the alignment comprises a camera.

12. The method according to claim 1, wherein in the aligning step, the bank note is aligned by displacing the bank note in a direction substantially orthogonal to the transport direction.

13. The apparatus according to claim 3, wherein the means for aligning displaces the bank note in a direction substantially orthogonal to the transport direction.

* * * * *